United States Patent [19]

Okano et al.

[11] Patent Number: 4,760,425

[45] Date of Patent: Jul. 26, 1988

[54] DEVELOPER SUPPLY APPARATUS FOR ELECTROPHOTOGRAPHIC SYSTEM

[75] Inventors: Takeshi Okano; Sadaaki Nakaoka, both of Hyogo; Shichi Ohtsuka, Kanagawa, all of Japan

[73] Assignee: Fuji Photo Film Co., Ltd., Kanagawa, Japan

[21] Appl. No.: 946,213

[22] Filed: Dec. 23, 1986

[30] Foreign Application Priority Data

Dec. 23, 1985 [JP] Japan ..... 60-289871

[51] Int. Cl.[4] ..... G03G 15/10; G03D 3/06

[52] U.S. Cl. ..... 355/10; 355/3 R; 355/7; 118/659; 430/117; 354/324

[58] Field of Search ..... 355/3 R, 7, 10; 430/117–119; 354/317, 324; 118/659, 662

[56] References Cited

U.S. PATENT DOCUMENTS

| | | | |
|---|---|---|---|
| 3,528,355 | 9/1970 | Blackert | 355/10 X |
| 3,697,173 | 10/1972 | Sasaki et al. | 355/10 X |
| 3,936,854 | 2/1976 | Smith | 355/10 X |
| 3,964,828 | 6/1976 | Yamada et al. | 355/10 |
| 3,972,610 | 8/1976 | Gross | 355/7 |
| 4,110,029 | 8/1978 | Goshima et al. | 355/10 |
| 4,398,818 | 8/1983 | Jeromin et al. | 355/10 |
| 4,461,561 | 7/1984 | Plumadore | 355/3 R |
| 4,545,326 | 10/1985 | Carl | 355/10 X |
| 4,600,291 | 7/1986 | Ohtsuka et al. | 355/10 X |
| 4,613,226 | 9/1986 | Kimura et al. | 355/10 |
| 4,622,915 | 11/1986 | Ohtsuka et al. | 355/10 X |
| 4,623,240 | 11/1986 | Kimura et al. | 355/10 |
| 4,629,303 | 12/1986 | Vermarien | 354/324 X |

*Primary Examiner*—Patrick R. Salce
*Assistant Examiner*—Emanuel Todd Voeltz
*Attorney, Agent, or Firm*—Sughrue, Mion, Zinn, Macpeak and Seas

[57] ABSTRACT

A developer supply apparatus for a processing head which develops an image exposure-formed on an electrophotographic film by a developer. The developer, which is stored in a bottle, is pumped up to a switching valve by the expansion and contraction of a bellows. The switching valve is selectively set in two positions, that is, a first position for returning the pumped developer to the bottle thereby stirring the developer, and a second position for delivering the developer to the processing head to effect development. The bellows is capable of supplying an amount of developer which is required for the processing head to effect one developing operation with one stroke, thus enabling development to be reliably carried out.

18 Claims, 23 Drawing Sheets

86
84
78
62
54
56
208
44
196
92
90A
90
74
90C
164
76
172
82
164A
210
164C
64
58
90B
188
96
90D
186
66
184
172
74
164B
170
168
68
70
58

DEVELOPER SUPPLY APPARATUS FOR ELECTROPHOTOGRAPHIC SYSTEM

BACKGROUND OF THE INVENTION

1. Field of the Invention

The present invention relates to a developer supply apparatus employed in an electrophotographic system to supply a developer to a developing section provided in a processing head which subjects an electrophotographic film to various kinds of processing.

2. Description of the Related Art

One type of photographic system has heretofore been known which is capable of recording an image on a predetermined frame of a photographic film and of projecting or copying the recorded image. This type of system is disclosed in, for example, U.S. Pat. Nos. 3,528,355, 3,697,173, 3,964,828, 3,972,610 and 4,461,561.

A processing head is disposed in such photographic system to subject an electrophotographic film to various kinds of processing such as charging/exposure and development and such processing head is known from the specifications of U.S. Pat. No. 4,600,291 and U.S. patent application Ser. No. 696,590 filed Jan. 31, 1985, now U.S. Pat. No. 4,623,240.

A developing section provided in the processing head is supplied with a developer by means of a developer supply apparatus. In a typical conventional developer supply apparatus, a developer which is stored in a bottle is pumped up into a tank using a pump and then allowed to be gravitationally supplied to the developing section in the processing head by controlling a solenoid valve disposed below the tank.

The conventional developer supply apparatus suffers, however, from the following problems. Since the developer stored in the bottle must be pumped up into the tank with the pump before being supplied to the developing section, it is necessary to provide additional elements such as a tank and a pipe for providing communication between the tank and the bottle, which means that the structure of the apparatus is complicated and the production cost is raised, disadvantageously. Further, since the developer is gravitationally supplied, if there is a change in flow resistance of the flow passage due to, for example, adhesion of the toner contained in the developer to the inner wall of the pipe, it becomes difficult to accurately supply an amount of developer that is required to develop one frame on a film.

SUMMARY OF THE INVENTION

In view of the above-described circumstances, it is a primary object of the present invention to provide a developer supply apparatus for an electrophotographic system which is capable of accurately supplying an amount of developer that is required to develop one frame on a film with a simplified arrangement.

To this end, the present invention provides a developer supply apparatus for a processing head which subjects an electrophotographic film to various kinds of processing such as development, the apparatus comprising: a bellows whose internal volume is variable; driving means for expanding and contracting the bellows; suction means adapted to suck in a developer from a developr supply source when the bellows is contracted, and to pump out the sucked developer when the bellows is expanded; and a switching valve which is selectively set in two positions, that is, a first position for delivering the developer pumped out from the suction means to the processing head, and a second position for returning the developer to the developer supply source.

With the above-described arrangement, the switching valve is actuated to provide communication between the processing head and the suction means, and the internal volume of the bellows is varied by the driving means. In consequence, when the internal volume of the bellows is increased, the developer is allowed to flow into the suction means through a check valve. When the internal volume of the bellows is decreased by the driving means, the developer is prevented from flowing out by the operation of the check valve. Accordingly, the developer is supplied to the processing head through the swithcing valve. If the amount of change in internal volume of the bellows is set so as to correspond to an amount of developer which is required to develop one frame on a film, it is possible to intermittently supply an adequate amount of developer for each frame. In addition, when the position of the switching valve is changed so as to allow the suction means and the developer supply source to communicate with each other, the developer can be circulated and thereby stirred. When the processing head and the developer supply source are communicated with each other, any unused developer remaining in the piping can be recovered.

The above and other objects, features and advantages of the present invention will become more apparent from the following description of the preferred embodiments thereof, taken in conjunction with the accompanying drawings.

DESCRIPTION OF THE PREFERRED EMBODIMENT

The present invention will be described hereinunder in detail with reference to the accompanying drawings.

Figure 1:
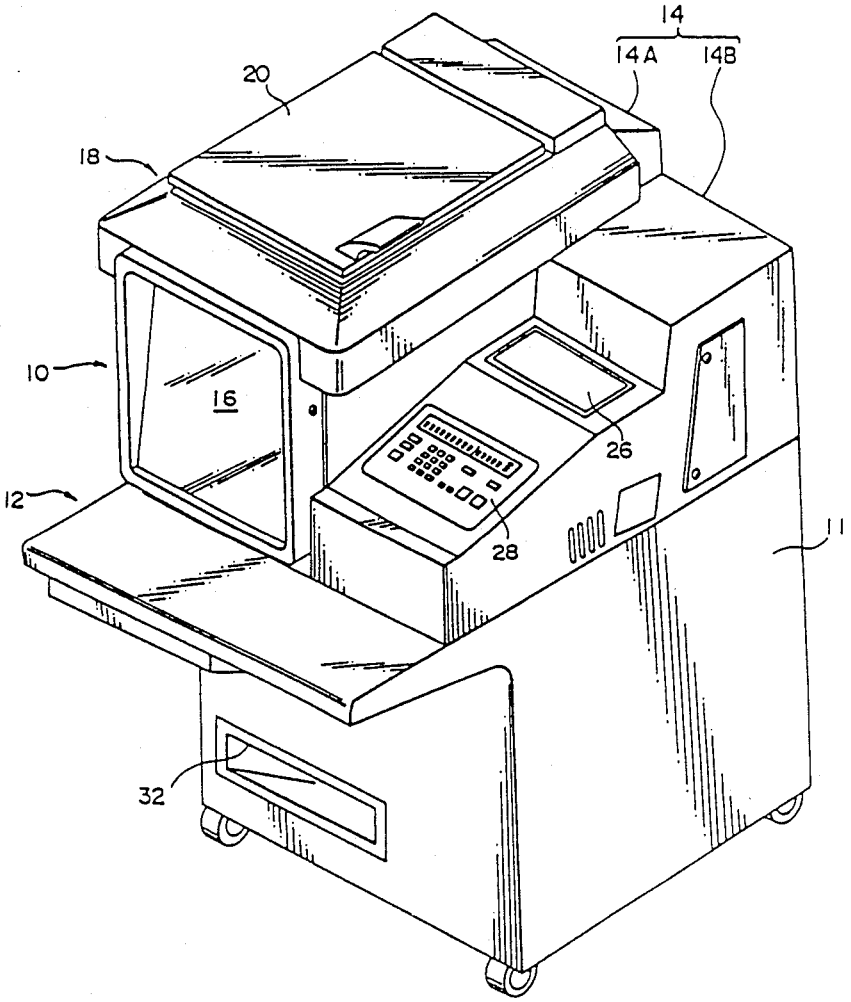
FIG. 1 is a perspective view showing the external appearance of one example of an electrophotographic system.

FIG. 1 shows one example of an electrophotographic system in which one embodiment of the developer supply apparatus according to the present invention is disposed.

The electrophotographic system in accordance with this embodiment has various functions: namely, the camera function which enables the image of a document to be recorded on an electrophotographic film; the reader function which enables the image recorded on the film to be enlarged and projected on a screen; and the copy function which enables the image recorded on the film to be enlarged and copied on a sheet of copying paper.

The electrophotographic system has an integral structure which consists of an electrophotographic system body 10, a housing 11, and a copying machine 12 serving also as a table for mounting the body 10. When the copy function is not needed, the body 10 may be used alone. The body 10 includes a housing 14 which consists of a left-hand portion 14A having a substantially rectangular parallelepiped configuration and a right-hand portion 14B which has a stepped upper surface. The respective internal spaces of these portions 14A and 14B are communicated with each other at the side thereof which is closer to the rear end of the system.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate 20 in such a manner as to close an opening provided in the upper side of the housing portion 14A. A cassette loading section 26 into which a cassette accommodating an electrophotographic microfilm 24 (see FIG. 2; hereinafter referred to as an "electrophotographic film") is loaded is provided in the central portion of the upper side of the housing portion 14B. A control keyboard 28 through which various controls of the electrophotographic system are effected is disposed on the front portion of the upper side of the housing portion 14B.

Figure 4:
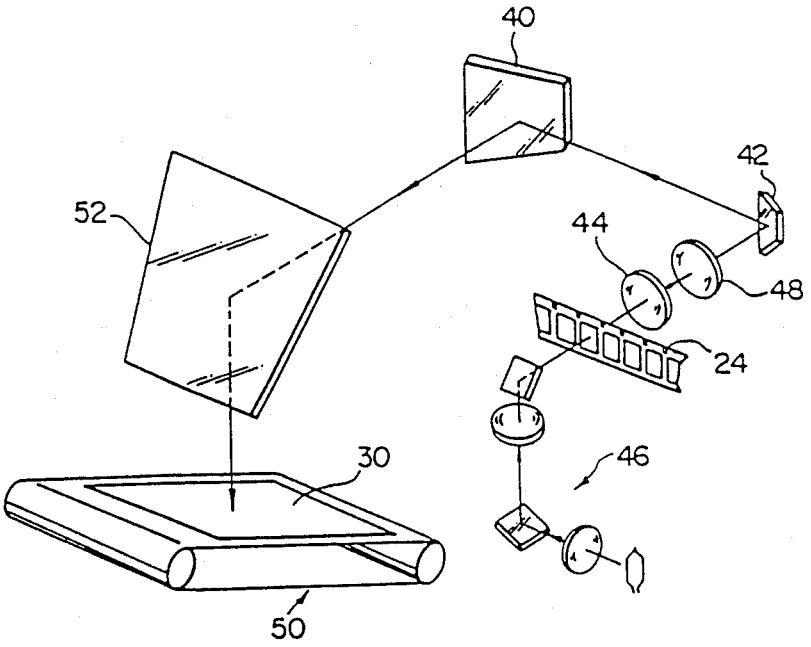
FIG. 4 is a schematic perspective view of a copying optical system in the electrophotographic system.

The housing 11 of the copying machine 12 is provided with an opening 32 for delivering a copied sheet of paper 30 (see FIG. 4).

[Optical Systems of Electrophotographic Apparatus]

Figure 2:
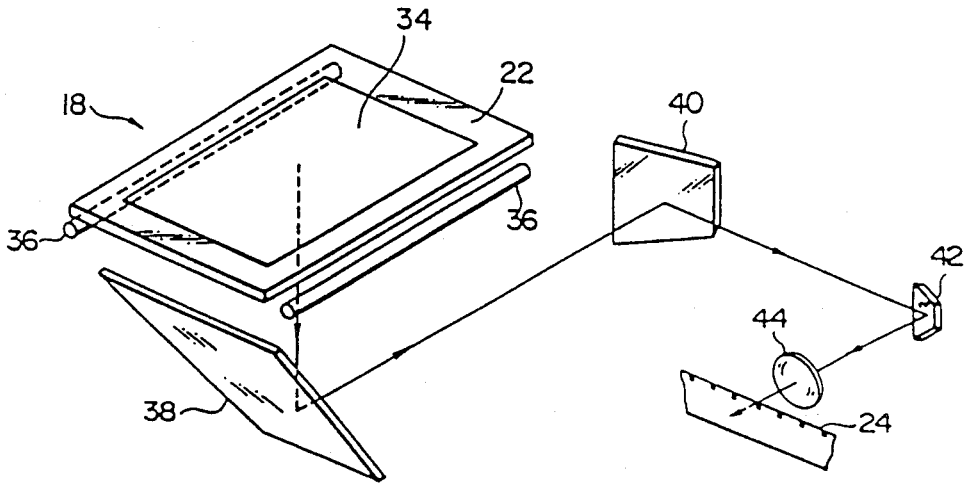
FIG. 2 is a schematic perspective view of a recording optical system in the electrophotographic system.
Figure 3:
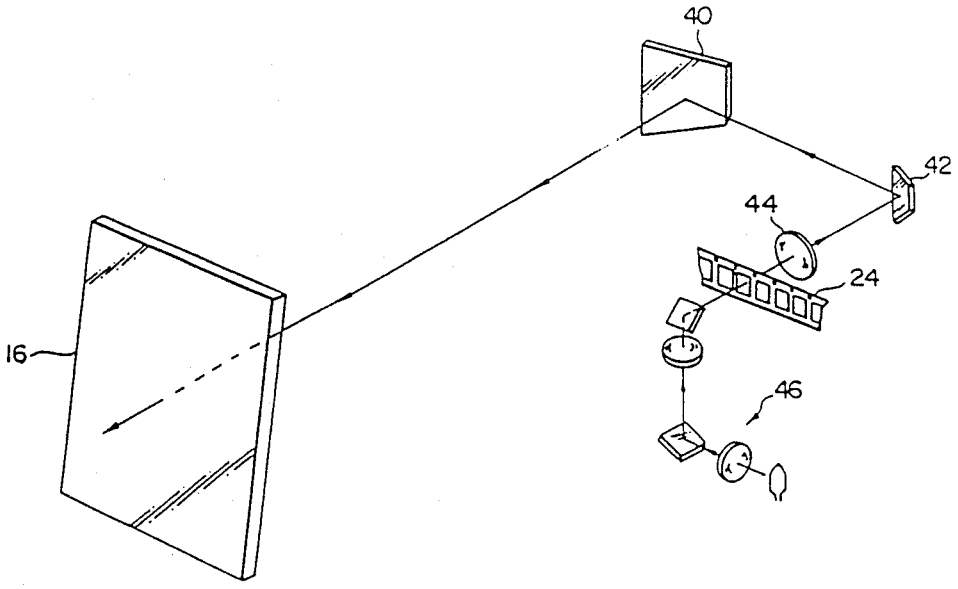
FIG. 3 is a schematic perspective view of a projecting optical system in the electrophotographic system.

FIGS. 2 to 4 show various optical systems of the electrophotographic system.

Referring first to FIG. 2, the recording optical system includes document illuminating lamps 36 which illuminate a document 34 as a subject that is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected from the second mirror 40 is made incident, and a main lens 44 for focusing the light reflected from the first mirror 42 on the surface of an electrophotographic film 24.

Referring next to FIG. 3, the projecting optical system includes a projecting light source section 46 for irradiating the electrophotographic film 24, the main lens 44 for focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes the projecting light source section 46, the main lens 44, the first mirror 42, the second mirror 40, a conversion lens 48 disposed between the main lens 44 and the first mirror 42 to slightly reduce the optical image formed on the first mirror 42, and a copy mirror 52 adapted to reflect the light reflected from the second mirror 40 toward a sheet of copying paper 30 set on an exposing table 50 disposed in the copying machine 12.

The main lens 44 and the first and second mirrors 42, 40 are mutually used for the above-described three optical systems. The main lens 44 and the first mirror 42 are fixedly disposed within the housing portion 14B of the electrophotographic system body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the body 10, while the conversion lens 48 is movably disposed within the housing portion 14B so that the lens 48 is prevented from interfering with any other optical systems. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic system.

[Processing Head]

FIGS. 5 to 17 show in combination one example of the processing head which is disposed in the above-described electrophotographic system.

Figure 5:
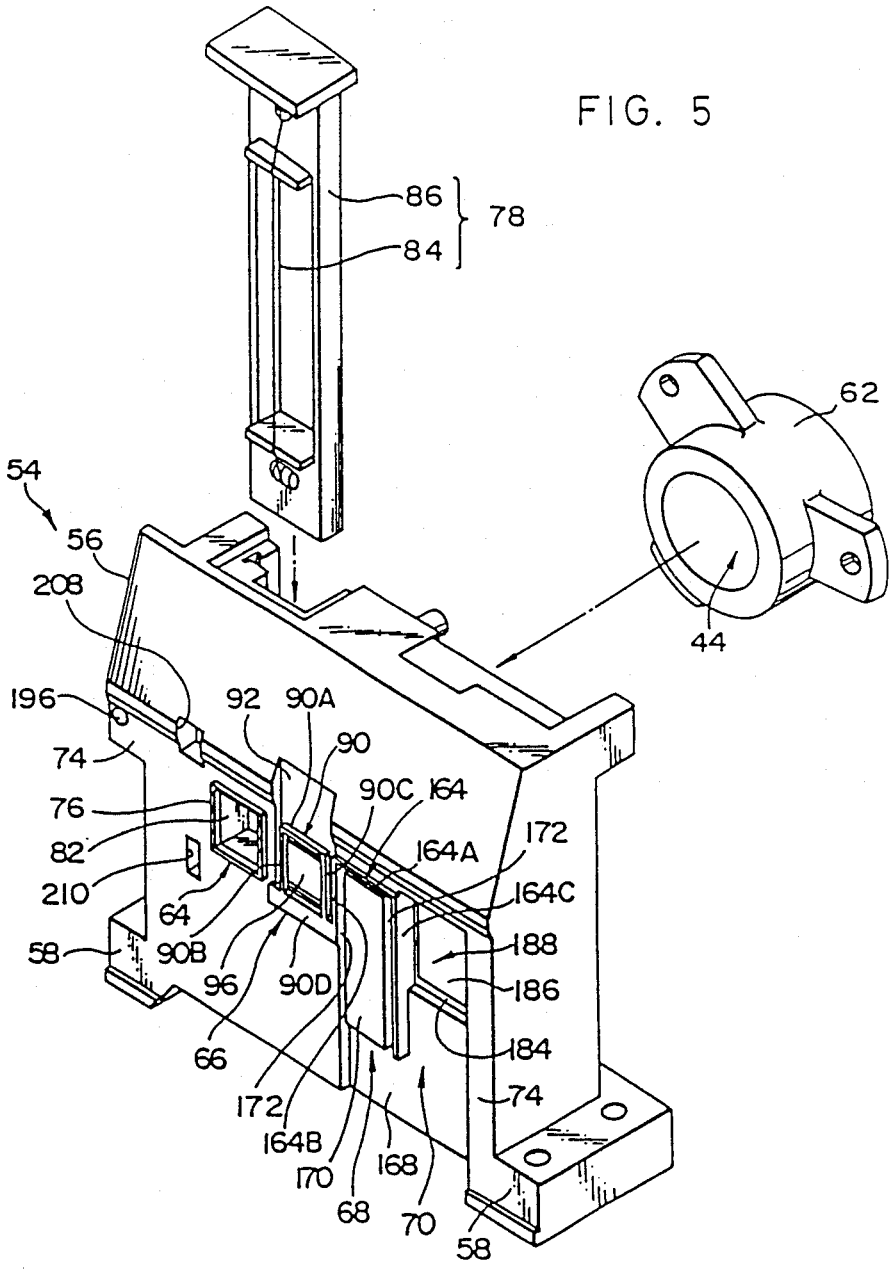
FIG. 5 is an exploded perspective view of a processing head in accordance with one embodiment of the present invention which is disposed in the electrophotographic system shown in FIG. 1.
Figure 6:
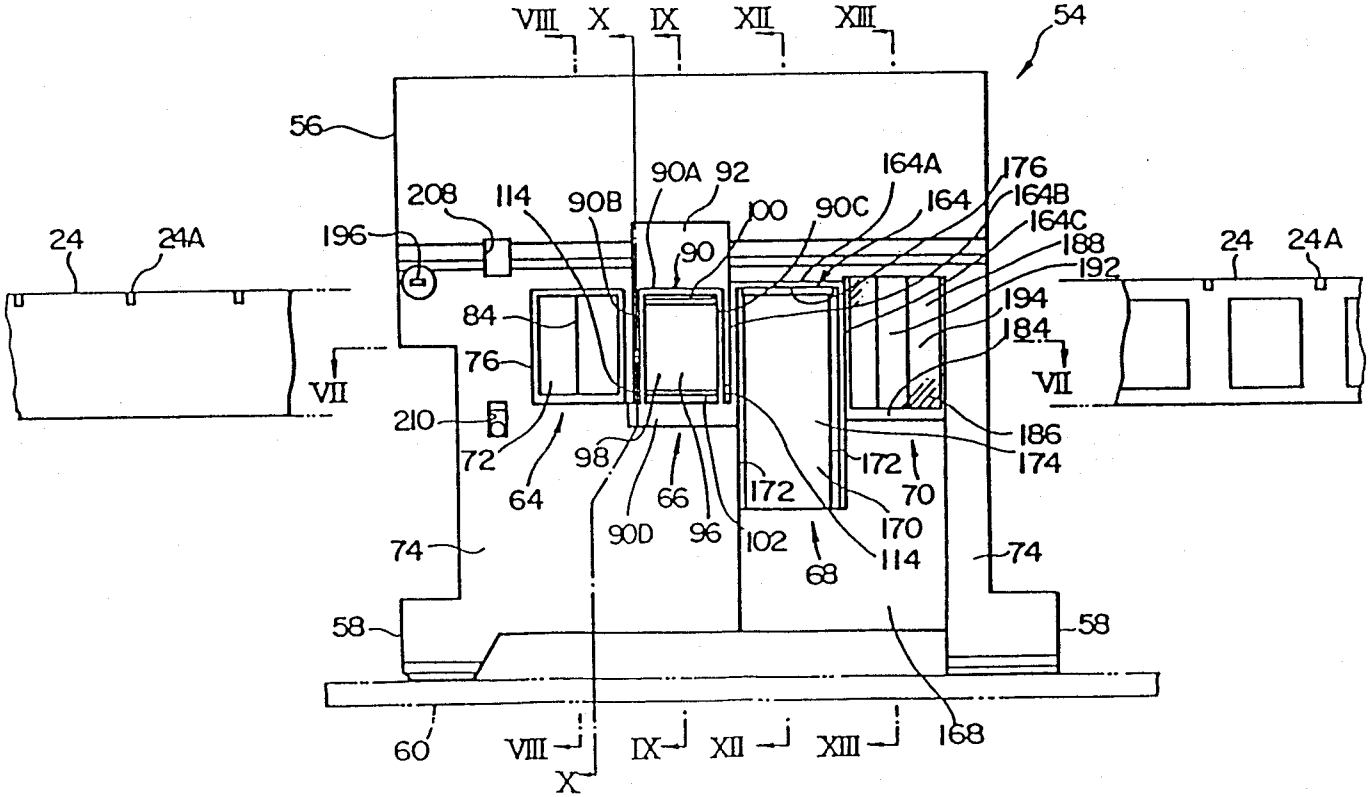
FIG. 6 is a front view of the processing head.

Referring first to FIGS. 5 and 6, the processing head 54 has an integral structure which consists of a relatively flat body portion 56 having a substantially rectangular parallelepiped configuration, and a pair of leg portions 58 located below the body portion 56. The processing head 54 is formed form a synthetic resin by an integral molding process except for fitting members. The processing head 54 is disposed between the main lens 44 and the electrophotographic film 24, which are shown in FIGS. 2 to 4, and the leg portions 58 are secured to a frame 60 disposed within the housing portion 14B of the system body 10, as shown in FIG. 6.

Figure 7:
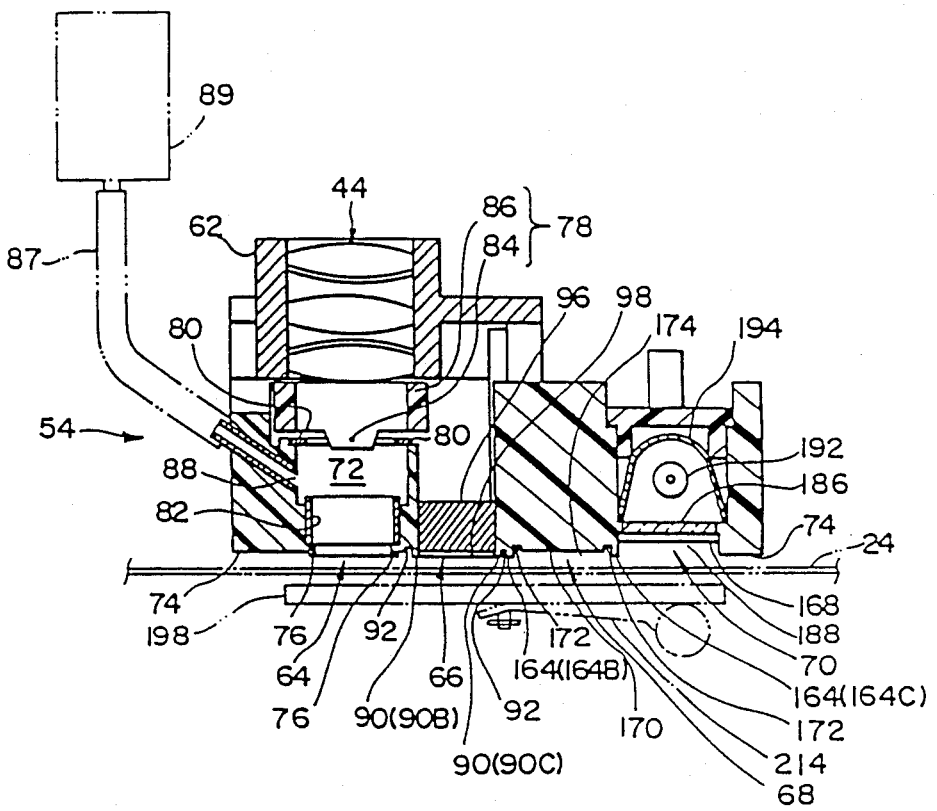
FIG. 7 is a sectional view taken along the line VII—VII in FIG. 6.

The main lens 44 is, as shown in FIGS. 5 and 7, fitted in a lens tube 62 which, in turn, is secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A are printed in advance on the upper edge (as viewed in FIG. 6) of the film 24 at predetermined regular spacings in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (the horizontal direction as viewed in FIG. 6) of the processing head 54 by driving a film moving motor (not shown). The transparent electrically conductive layer of the film 24 is adapted to provide electrical connection with the system body 10 when the cassette is loaded therein. It is a matter of course that any type of known electrophotographic film may be employed in addition to the film of the type described above.

As shown in FIGS. 5 to 7, a charging exposure section 64, a developing section 66, a drying section 68 and a fixing section 70 are successively formed in the body portion 56 of the processing head 54 along the lateral direction thereof at a constant pitch which corresponds to the frame pitch of the film 24.

[Charging Exposure Section]

Figure 8:
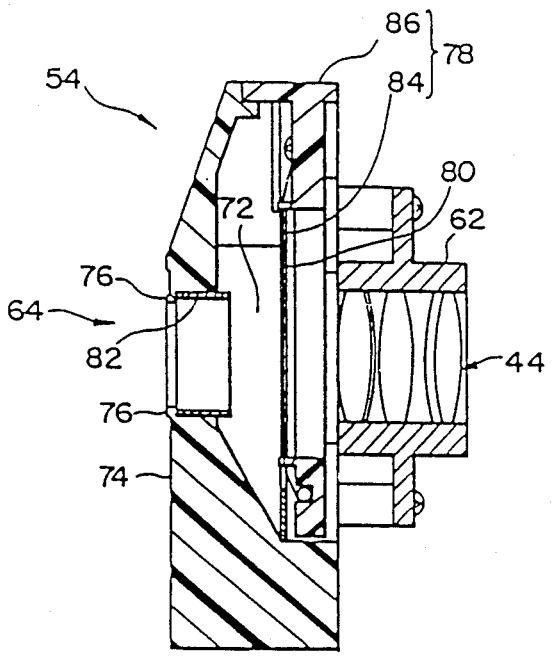
FIG. 8 is a sectional view taken along the line VIII—VIII in FIG. 6.

As shown in FIGS. 7 and 8, the charging exposure section 64 has a charging exposure chamber 72 which is defined by an internal space provided on the reverse side of a front wall 74 of the processing head 54. The chamber 72 is communincated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to one frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and disposed in the vicinity of the opening in the front wall 74. The corona wire 84 is connected to a high-voltage power supply, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 89 through a pipe 87. The main lens 44, which is mounted on the rear side of the processing head 54 through the lens tube 62, has the optical axis thereof made coincident with the center of the opening defined by the mask 76.

[Developing Section]

As shown in FIGS. 5 and 6, the developing section 66 has a mask 90. The mask 90 is defined by an upper frame member 90A, left and right frame members 90B, 90C, and a lower frame member 90D. The upper frame member 90A and the left and right frame members 90B and 90C rise from the surface of a recess 92 formed in the front wall 74, and the lower frame member 90D rises from the front wall 74. Both longitudinal end portions of the lower frame member 90D project horizontally from the joints between the frame member 90D and the left and right frame members 90B and 90C. The amount by which the mask 90 projects is set so that the mask 90 is flush with the mask 76.

The width of the opening defined by the mask 90 is set such as to be slightly smaller than that of the opening defined by the mask 76. The height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

Figure 9:
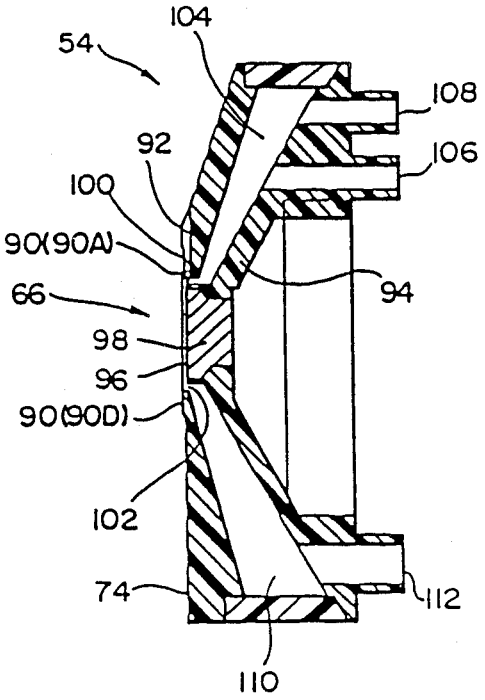
FIG. 9 is a sectional view taken along the line IX—IX in FIG. 6.

As shown in FIG. 9, a developing electrode 96 is disposed within the opening defined by the mask 90, the electrode 96 being supported by a rear wall 94. The developing electrode 96 is connected to a bias power supply. The developing electrode 96 is positioned in such a manner that the outer surface thereof is located at a position which is slightly inner than the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and the mask 90 to define a developer and squeezing air outlet 102.

The developer and squeezing air inlet 100 is communicated with a passage 104 which is defined by a space inside the processing head 54. The passage 104 is communicated with a developer supply port 106 and a squeezing air supply port 108, which are provided in the rear side of the processing head 54. The developer and squeezing air outlet 102 is communicated with a passage 110 defined by a space inside the processing head 54. The passage 110 is communicated with a developer and squeezing air discharge port 112 which is provided in the rear side of the processing head 54.

Figure 10:
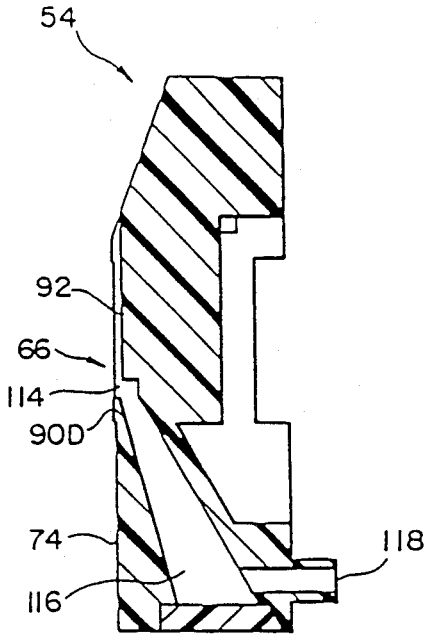
FIG. 10 is a sectional view taken along the line X—X in FIG. 6.

Recesses 92 are respectively provided on the outer sides of the left and right frame members 90B and 90C of the mask 90. As shown in FIGS. 6 and 10, a squeezing suction port 114 is provided at the lower end of each of the recesses 92. The suction ports 114 are, as shown in FIG. 10, communicated with a passage 116 which is defined by a space inside the processing head 54. The passage 116 is communicated with a suction squeeze opening 118 provided in the rear side of the processing head 54.

Figures 11A, 11B:
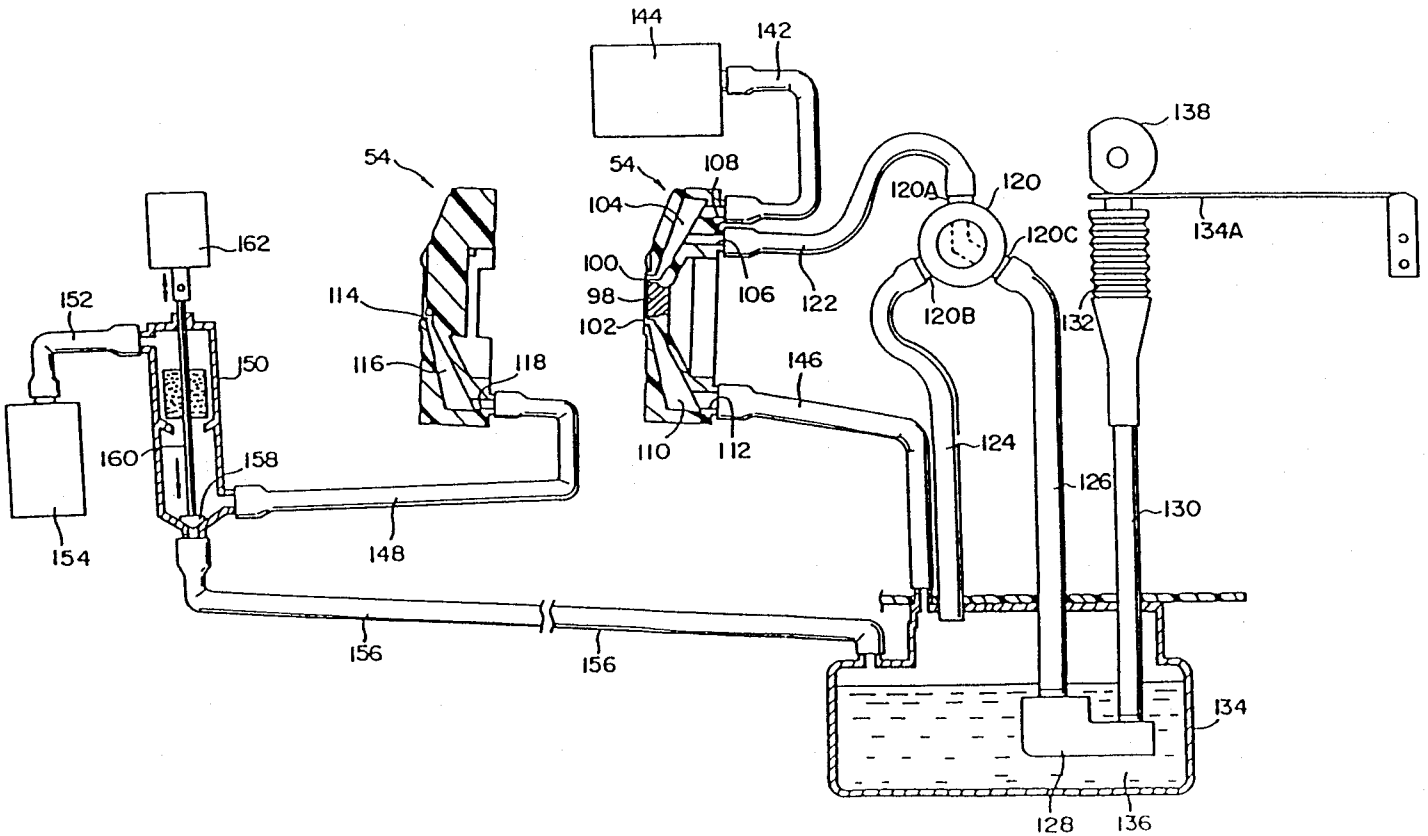
FIG. 11 shows the relationship between the developing section provided in the processing head and one embodiment of the developer supply apparatus according to the present invention.

Referring to FIG. 11(A), the developer supply port 106 is connected to a first branch passage 120A of a three-way cock 120 through a pipe 122. A second branch passage 120B of the three-way cock 120 is connected to a pipe 124 which extends through an upper cover of a developer bottle 134 so as to project into the bottle 134. A third branch passage 120C of the three-way cock 120 is connected through a pipe 126 to a suction unit 128 which is immersed in a developer 136 contained in the developer bottle 134. The suction unit 128 is connected to a bellows 132 made of polyethylene through a pipe 130. The upper end portion of the bellows 132 is in contact with a cam 138 through a cushioning plate 134A.

Figures 12A, 12B, 12C:
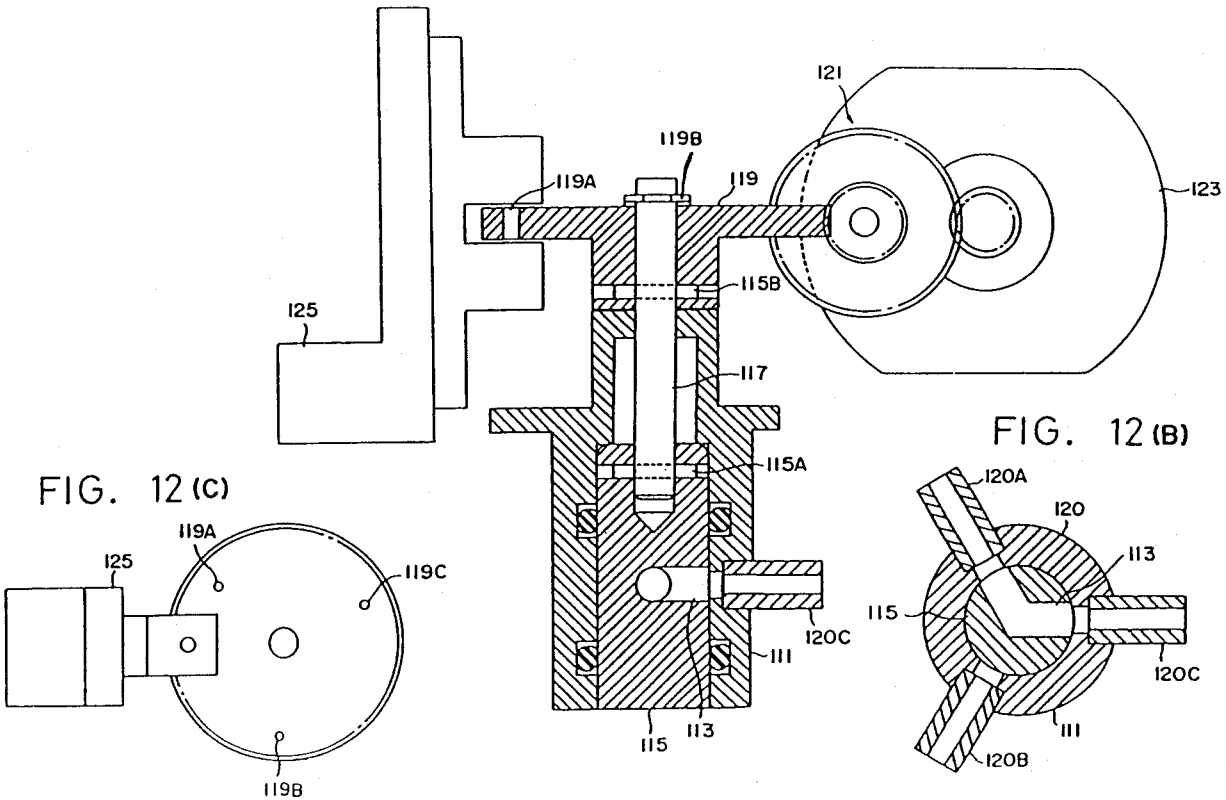
FIGS. 12 to 14 are detail views showing various portion of the developer supply apparatus illustrated in FIG. 11.

As shown in FIGS. 12(A), 12(B) and 12(C), the three-way cock 120 has a cylindrical outer casing 111. The outer casing 111 accommodates a columnar valve body 115 having a bent passage 113 which extends in a direction perpendicular to the axis of the outer casing 111 and which is bent at an angle of 120° so that the passage 113 is selectively communicatable with two of the branch passages 120A to 120C. O-rings are respectively provided around slide portions of the valve body 115 which are on the upper and lower sides of the bent passage 113. One end of the valve body 115 is connected to one end of a shaft 117 by a spring pin 115A. A driving gear 119 is connected to the other end of the shaft 117 by a spring pin 115B and an E-ring 115C. The driving gear 119 has through-holes 119A to 119C which are provided near the peripheral edge of the gear 119 and which are spaced along the circumference every 120°, the through-holes 119A to 119C extending in the direction of thickness of the gear 119. The positions of the through-holes 119A to 119C respectively correspond to those of the branch passages 120A to 120C. The driving gear 119 is operatively connected to the output shaft of a motor 123 through a gear train 121. A photointerrupter 125 is disposed so as to sandwich the driving gear 119 with clearances therebetween. The photointerrupter 125 detects two of the branch passages 120A to 120C which are communicated with the bent passage 113 in the valve body 115 by detecting one of the through-holes 119A to 119C. More specifically, when the branch passages 120A and 120C are communicated with each other as shown in FIG. 12(B), the through-hole 119A is detected by the photointerrupter 125, whereas, when the valve body 115 is rotated 120° counterclockwise so as to allow the branch passages 120A and 120B to communicate with each other, the through-hole 119C is detected by the photointerrupter 125. When the valve body 125 is further rotated 120° so as to allow the branch passages 120B and 120C to communicate with each other, the through-hole 119B is detected by the photointerrupter 125.

Figure 13A:
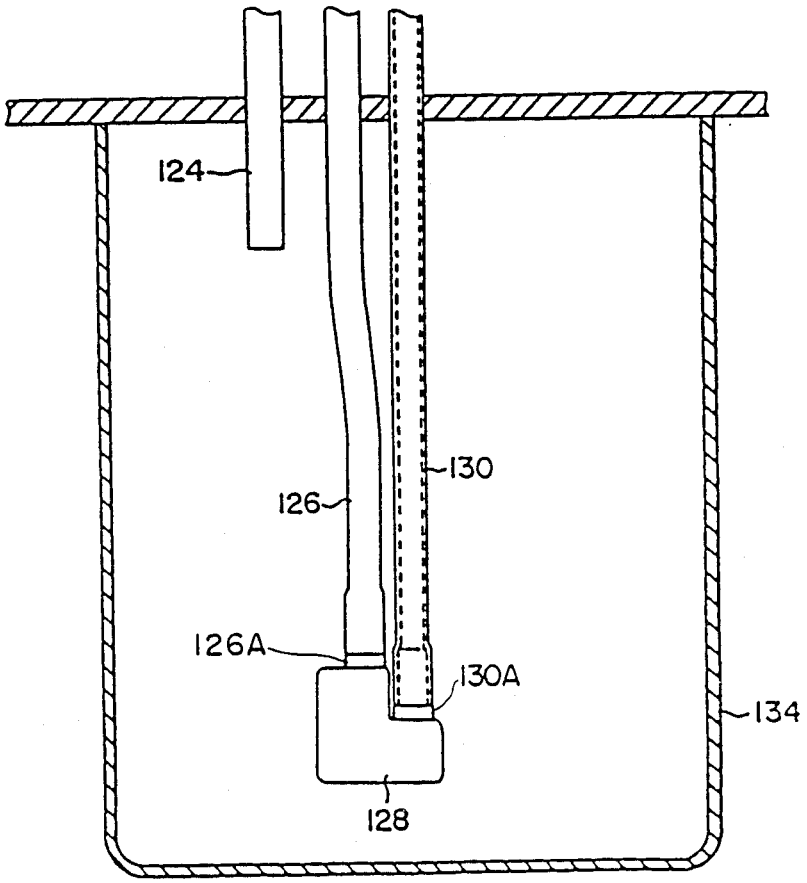
Figures 13B, 13C:
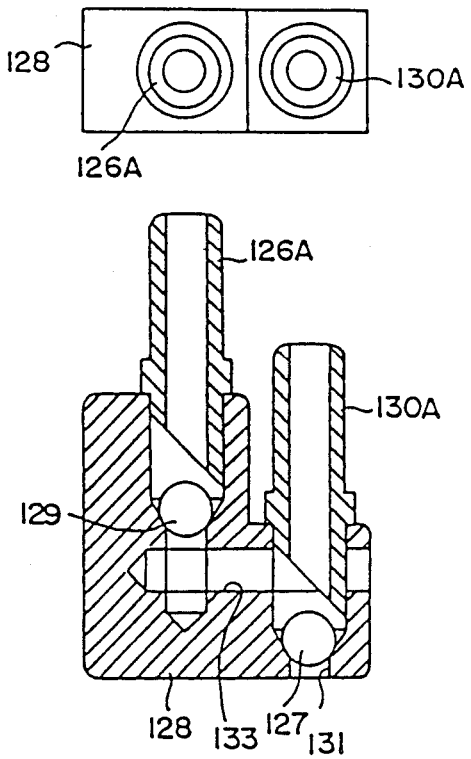

As shown in FIGS. 11(A) and 13(A), the suction unit 128 is connected to the pipes 126 and 130. Connecting pipes 126A and 130A which are respectively connected to the pipes 126 and 130 project from the suction unit 128 as shown in FIGS. 13(B) and 13(C). In addition, ball-shaped check valves 127 and 129 are accommodated inside the suction unit 128. The check valve 127 is disposed so as to selectively open and close a suction port 131, while the check valve 129 is disposed so as to selectively open and close a passage 133 which provides communication between the connecting pipes 126A and 130A and which also defines a developer chamber.

Figure 14A:
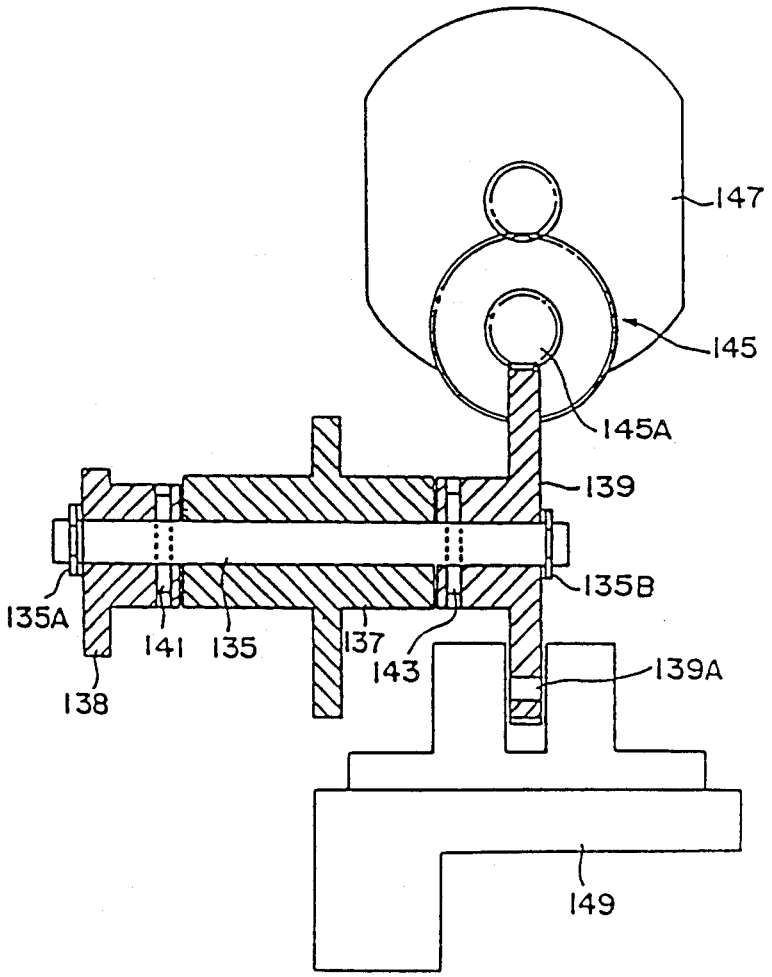
Figure 14B:
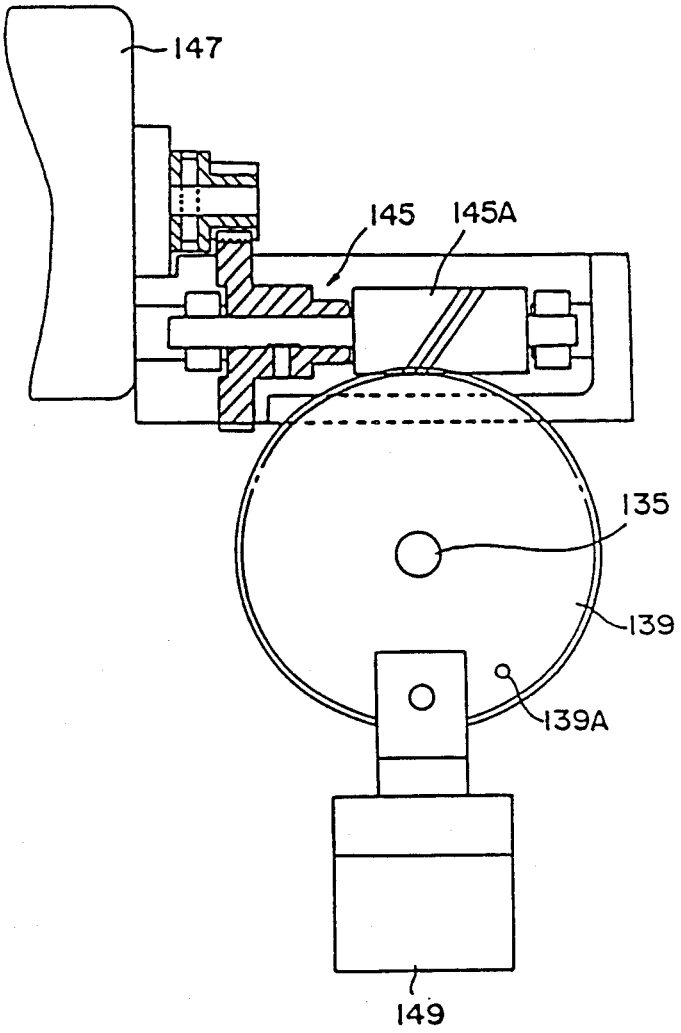

As shown in FIGS. 14(A) and 14(B), the cam 138 is rigidly secured to one end of a shaft 135 by a spring pin 141 and an E-ring 135A, the shaft 135 extending through an outer casing 137. A driving gear 139 is rigidly secured to the other end of the shaft 135 by a spring pin 143 and an E-ring 135B. The driving gear 139 is operatively connected to the output shaft of a motor 147 through a worm 145A and a gear train 145. A through-hole 139A is bored in the driving gear 139 so as to extend in the direction of thickness of the gear 139. A photointerrupter 149 is disposed in such a manner as to sandwich the driving gear 139 with clearances therebetween. The photointerrupter 149 detects whether or not the cam 138 has rotated on full turn by detecting the through-hole 139A.

Figure 15:
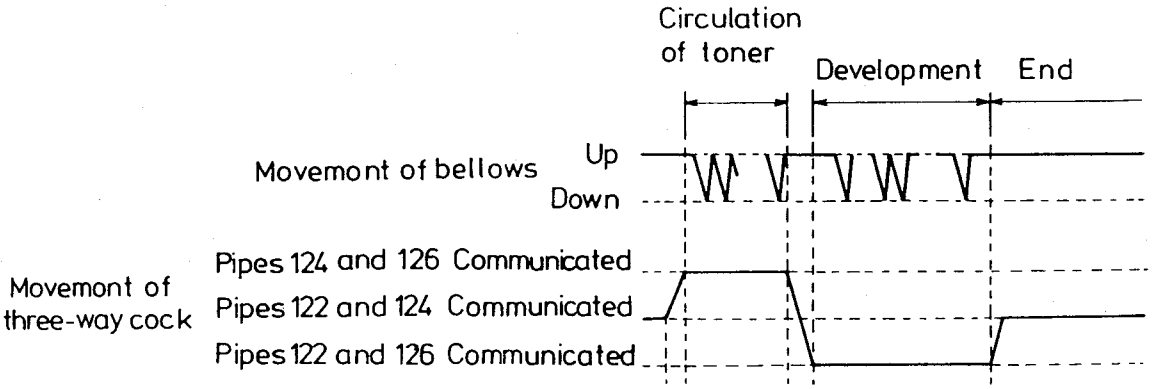
FIG. 15 is a chart showing the movement of each of the bellows and three-way cock which are provided in the developer supply apparatus.

The operation of the developer supply apparatus arranged as detailed above will be explained below with reference to FIG. 15. Before starting supply of the developer 136, the position of the valve body 115 of the three-way cock 120 is so set that the pipes 124 and 126 are communicated with each other, and the cam 138 is rotated by activating the motor 147. The rotation of the cam 138 causes the bellows 132 to be contracted through the cushioning plate 134A. As the straight portion of the cam 138 comes in contact with the cushioning plate 134A, the bellows 132 is restored to its previous state by virtue the restoring force. At this time, as the internal volume of the bellows 132 increases, the check valve 127 is moved vertically upward, thus causing the developer 136 to be sucked into the suction unit 128 through the suction port 131. Subsequently, the bellows 132 is contracted again. In consequence, the suction port 131 is closed by the check valve 127, and the check valve 129 is moved vertically upward to allow the pipes 130 and 126 to communicate with each other, thus causing the developer 136 to flow through the three-way cock 120 and the pipe 124. In this way, the developer 136 is circulated and thereby stirred, and the toner is uniformly dispersed therein.

Then, the rotation of the cam 138 is temporarily suspended, and the position of the three-way cock 120 is switched so as to allow the the pipes 122 and 126 to communicate with each other, and the cam 138 is then rotated, whereby an amount of developer 136 which is required to develop one frame is intermittently supplied to the processing head 54.

After a developing operation has been completed, the rotation of the cam 138 is suspended, and the position of the three-way cock 120 is switched so as to allow the pipes 122 and 124 to communicate with each other, thus returning the unused developer 136 remaining in the pipe 122 to the developer bottle 134.

The squeezing air supply port 108 is connected to a pressure squeezing air pump 144 through a pipe 142. The developer and squeezing air discharge port 112 is connected with a return pipe 146 which opens into the developer bottle 134.

As shown in FIG. 11(B), the suction squeeze opening 118 is connected to a suction trap 150 through a pipe 148. The suction trap 150 is connected to a suction squeezing air pump 154 through a pipe 152. A return pipe 156 which opens into the developer bottle 134 is connected to the bottom of the suction trap 150. A valve 158 which is able to close the return pipe 156 is disposed at the joint between the suction trap 150 and the return pipe 156. The valve 158 is moved vertically by the action of a solenoid 162 through a shaft 160.

It should be noted that, as shown in FIG. 11, the processing head 54 is inclined with respect to the horizontal plane so that the optical axis of each of the optical systems is perpendicular to the surface of the screen 16 which is slanted.

[Drying Section]

Referring to FIGS. 5 and 6, the drying section 68 has a frame 164. The frame 164 consists of an upper frame member 164A and left and right frame members 164B and 164C and has no lower frame member. The left frame member 164B is contiguous with the right-hand end portion of the lower frame member 90D of the mask 90 and rises from the front wall 74 together with the upper frame member 164A. The right frame member 164C rises from a recess 168 which is depressed from the front wall 74 in the shape of a step.

Figure 16:
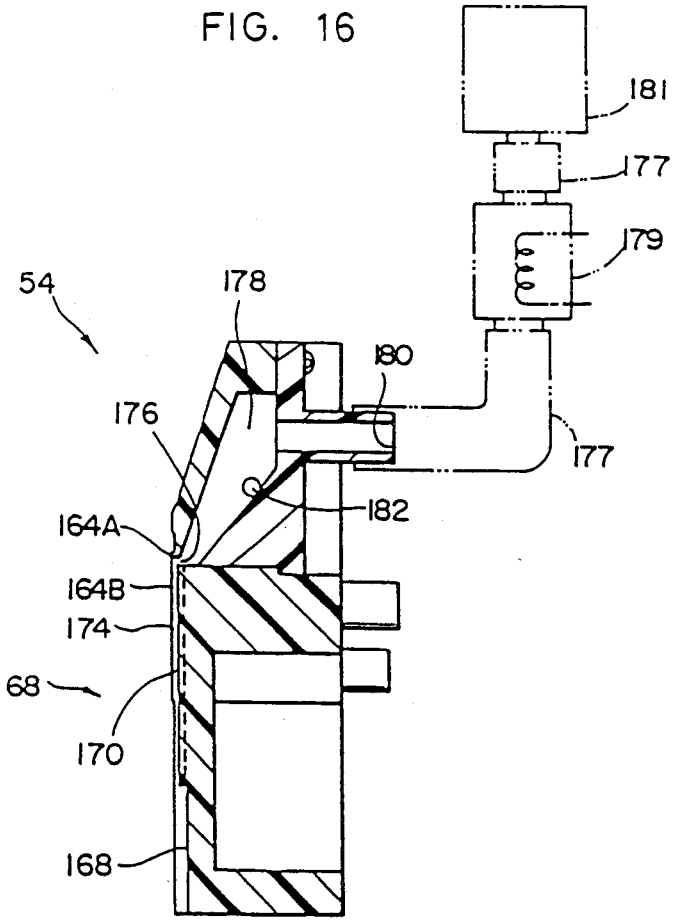
FIG. 16 is a sectional view taken along the line XII—XII in FIG. 6.

As shown in FIGS. 7 and 16, a wall 170 is formed between the left and right frame members 164B and 164C in such a manner that the surface of the wall 170 is located at a position which is slightly inner than the end face of the frame 164. In addition, recesses 172 are formed on both sides of the wall 170. The bottom surface of each recess 172 is raised from the wall surface of the recess 168 in the front wall 74. The space surrounded by the frame 164, the wall 170, and the recesses 172 defines a drying chamber 174. The distance between the opposing lateral inner surfaces of the frame 164 is set such as to be larger than the width of the opening defined by the mask 90. In addition, the lower surface (the frame inner surface) of the upper frame member 164A is positioned above that of the mask 90 in the developing section 66.

As shown in FIGS. 6 and 16, the lower portion of the upper frame member 164A is cut in the shape of a slit along the longitudinal direction of the frame member 164A, thereby providing a warm air outlet 176. The warm air outlet 176 is, as shown in FIG. 16, communicated with a passage 178 which is defined by a space inside the processing head 54. The passage 178 is communicated with a warm air supply port 180 which is provided in the rear side of the processing head 54. A temperature sensor 182 is disposed in the passage 178. The warm air supply port 180 is connected to a heater 179 and an air pump 181 through a pipe 177.

[Fixing Section]

The fixing section 70 is, as shown in FIGS. 5 to 7, defined between the right frame member 164C of the frame 164 and the right-hand end portion of the front wall 74. The fixing section 70 has a frame 184 which consists of a lower frame member and left and right frame members, the fraxe 184 being located at a position which is further depressed from the recess 168 in the front wall 74. A transparent glass plate 186 is fitted in the frame 184. The space provided on the front side of the glass plate 186 defines a fixing chamber 188.

Figure 17:
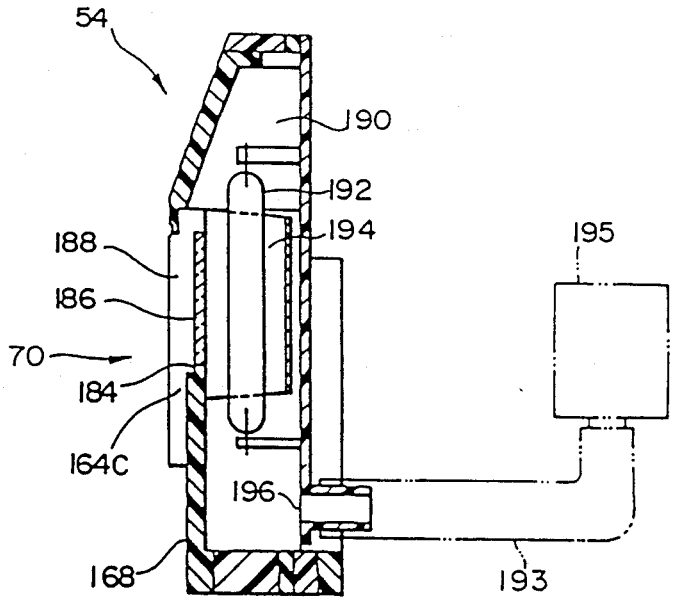
FIG. 17 is a sectional view taken along the line XIII—XIII in FIG. 6.

As shown in FIG. 17, a xenon lamp 192 and a reflecting plate 194 are disposed within a space 190 inside the processing head 54 which is provided on the reverse side of the glass plate 186. A cooling air inlet 196 opens into the space 190 so that cold air is supplied to the space 190 from an air pump 195 through a pipe 193. The space 190 and the fixing chamber 188 are communciated with each other through the area defined at the upper edge of the glass plate 186.

[Blip Sensor]

Referring to FIGS. 5 and 6, the processing head 54 has a blip sensor 196 which is disposed on the left-hand end portion of the front wall 74. The blip sensor 196 is located at a position at which the blip marks 24A printed on the electrophotographic film 24 pass, the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

[Film Pressing Mechanism]

Figure 18:
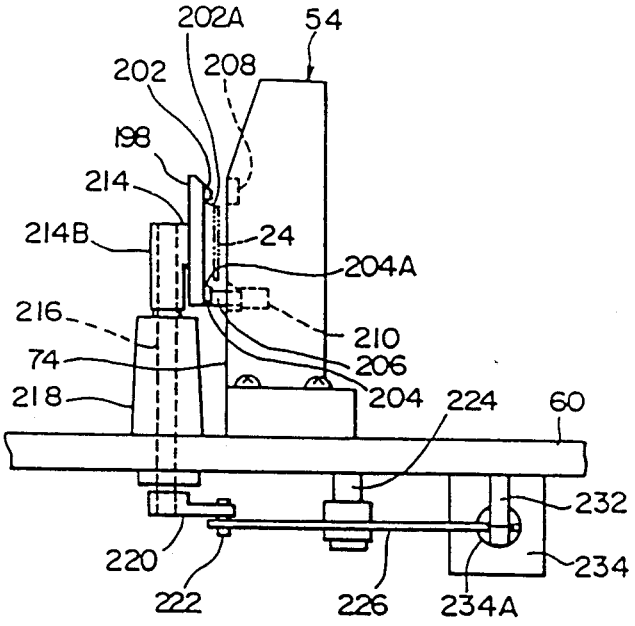
FIG. 18 is a schematic side view showing the positional relationship between the processing head and a pressing plate.

As shown in FIGS. 7 and 18, a pressing plate 198 is disposed in front of the front wall 74 of the processing head 54. The pressing plate 198 is, as shown in FIG. 19, provided with a rectangular through-hole 200 which is a size smaller than the opening defined by the mask 76 formed in the charging exposure section 64. The pressing plate 198 is disposed in such a manner that the through-hole 200 opposes the mask 76.

Figure 19A:
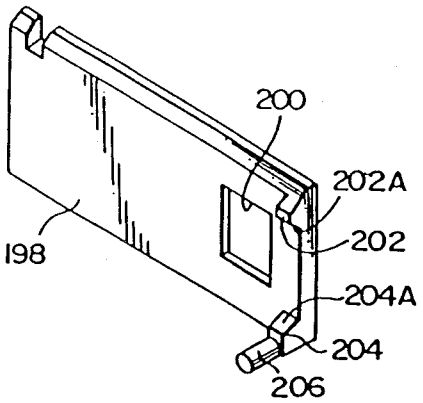
FIG. 19A is a perspective view of one of the elements shown in FIG. 19, as viewed from the opposite side.
Figure 19:
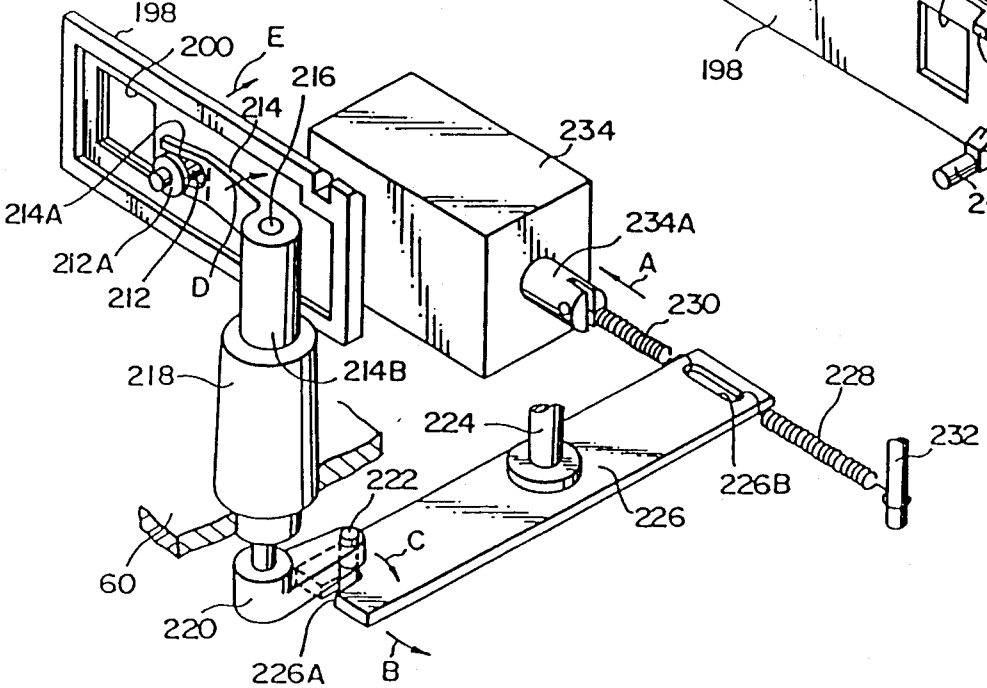
FIG. 19 is a perspective view of a film pressing mechanism disposed on the processing head.

As will be clear from FIG. 19A (a perspective view of the pressing plate 198 shown in FIG. 19, as viewed from the opposide side), the pressing plate 198 has fitting members 202 and 204 respectively formed on the upper and lower end portions on the side of the plate 198 which is closer to the through-hole 200, the fitting members 202 and 204 projecting toward the processing head 54. The opposing inner surfaces of the fitting members 202 and 204 are slanted as at 202A and 204A. The distance between the respective root portions of the upper and lower fitting members 202 and 204 is set such as to be equal to the width of the electrophotographic film 24 (strictly speaking, said distance being slightly larger than the width of the film 24), as shown in FIG. 18. A columnar portion 206 projects from the distal end of the fitting member 204. The fitting members 202 and 204 are able to be fitted into bores 208 and 210, respectively, formed in the front wall 74 of the processing head 54, as shown in FIGS. 5, 6 and 18.

The pressing plate 198 has a columnar portion 212 projecting from the reverse surface thereof, that is, the surface thereof which is remote from the procesing head 54. This columnar portion 212 is engaged with a notched portion 214A formed at one end portion of an arm 214. A stop ring 212A is rigidly secured to the distal end portion of the columnar portion 212 so as to prevent the notched portion 214A from coming off the columnar portion 212. A boss portion 214B is formed at the other end of the arm 214. A shaft 216 is rigidly secured to the boss portion 214B.

The shaft 216 is rotatably fitted into and thereby supported by a stand 218 projecting from the frame 60 to which the processing head 54 is secured, the lower end portion of the shaft 216 projecting from the reverse surface of the frame 60. A first lever 220 is rigidly secured to the projecting lower end portion of the shaft 216. A pin 222 is rigidly secured to the distal end portion of the first lever 220.

A shaft 224 is suspended from the reverse side of the frame 60. The shaft 224 pivotally supports the intermediate portion of a second lever 226. A notched portion 226A is formed at one end of the second lever 226, and the pin 222 is engaged with the notched portion 226A. A slot 226B is formed in the other end portion of the second lever 226, and one end portion of each of the tension coil springs 228 and 230 is retained by the slot 226B, the springs 228 and 230 biasing the second lever 226 in the opposite directions to each other so as to support the lever 226 resiliently.

The other end portion of the tension coil spring 228 is retained by a pin 232 suspended from the reverse side of the frame 60, while the other end portion of the tension coil spring 230 is retained by a plunger 234A of a pull-type solenoid 234 which is secured to the reverse side of the frame 60.

When the solenoid 234 is not energized, the pressing plate 198 is separated from the processing head 54. In this state, the pressing plate 198 is supported in such a manner that the columnar portion 206 is fitted into the bore 210 as shown in FIG. 18.

When the solenoid 234 is energized, the plunger 234A is activated to move in the direction of the arrow A, causing the tension coil springs 228 and 230 to be expanded against the biasing forces. In consequence, the second lever 226 is pivoted about the shaft 224 in the direction of the arrow B, so that the first lever 220 is pivoted about the pin 222 in the direction of the arrow C, thus causing the shaft 216 to turn in the same direction. Thus, the arm 214 is pivoted in the direction of the arrow D so as to press the pressing plate 198 in the direction of the arrow E.

The pressing plate 198 is moved in the direction of the arrow E while the columnar portion 206 is being guided by the bore 210, thus causing the film 24 to be pressed against the end faces of the masks 76, 90 and the frame 164. When the heightwise position of the film 24 is misaligned, the respective slanted surfaces of the fitting members 202 and 204 act so as to push down the upper edge of the film 24 or push up the lower edge thereof as the pressing plate 198 is moved in the direction of the arrow E.

When the pressing plate 198 is pressing the film 24 against the processing head 54, the fitting members 202 and 204 are respectively fitted in the bores 208 and 210, so that the film 24 is accurately positioned with respect to the processing head 54. In this state, the pressing plate 198 is allowed to resiliently press the film 24 by the action of the tension coil springs 228 and 230.

When the solenoid 234 is de-energized, the second lever 226, which is subjected to the biasing force from the spring 228, is pivoted counter to the direction of the arrow B. In consequence, the arm 214 is pivoted counter to the direction of the arrow D, so that the notched portion 214A presses the stop ring 212A, causing the pressing plate 198 to move counter to the direction of the arrow E.

The following is a description of the operation of this embodiment.

The electrophotographic system is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26 is locked at said position. In this state, the film 24 is positioned as shown in FIG. 18 and is allowed to move along the front side of the processing head 54 by the operation of a film moving motor (not shown).

When the image of the document 34 (shown in FIG. 2) is to be recorded on the film 24, the film moving motor (not shown) is activated to move the film 24 in such a manner that a given frame which is selected from the unexposed frames as desired is positioned in front of the mask 76 in the charging exposure section 64. This operation is executed by designating a desired frame through the control keyboard 28 shown in FIG. 1. The positioning of the selected frame with respect to the charging exposurre section 64 is effected by virtue of the blip sensor 196 which counts the number of passing blip marks 24A from a reference point.

Figure 20:
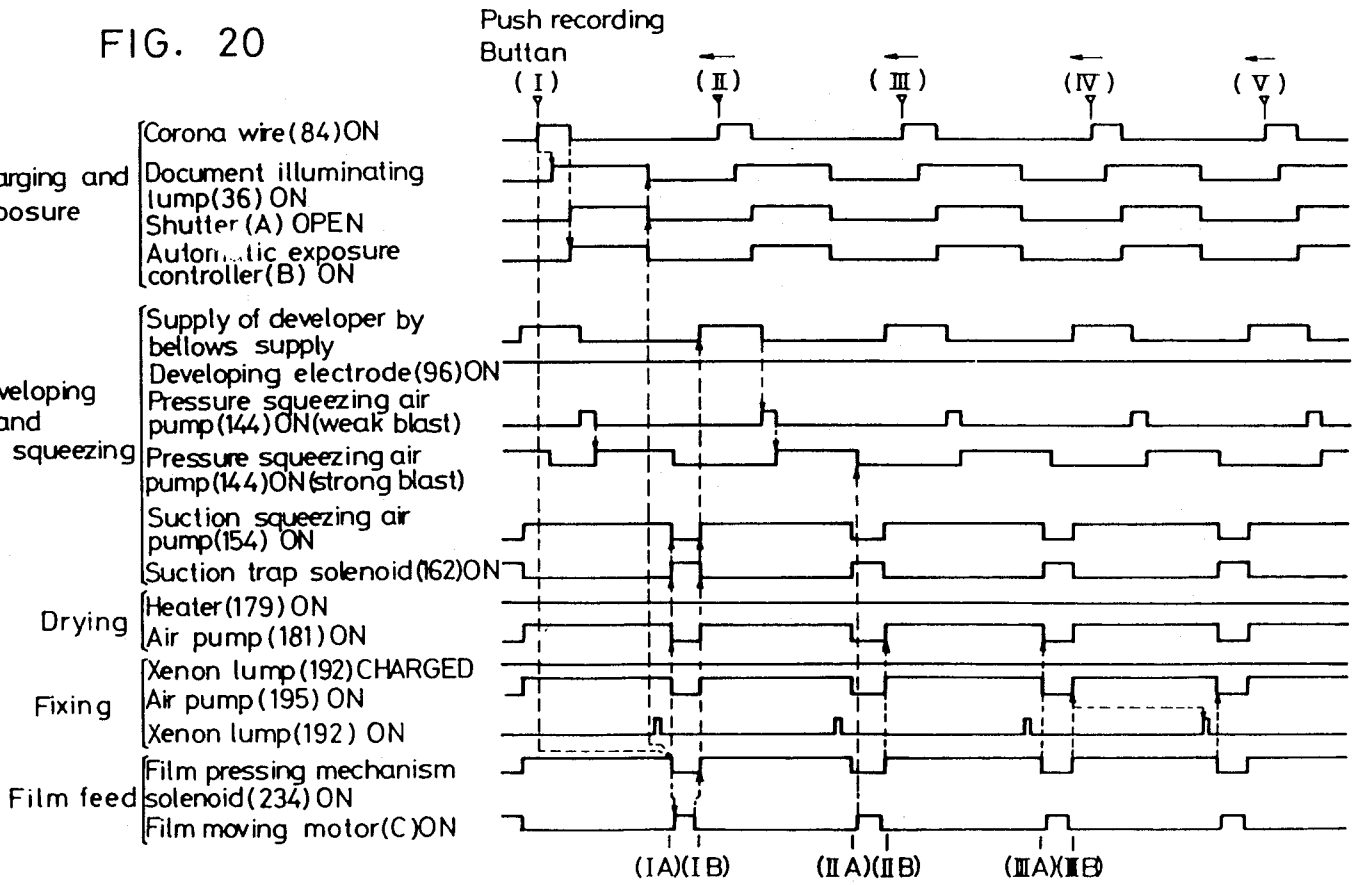
FIG. 20 is a time chart showing various operations of the electrophotographic system in the camera mode.

FIG. 20 is a time chart showing the operation of the system in the case where a given frame is positioned as described above and subjected to recording and, subsequently, continuous recording is effected on each of the frames which consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will be made about only one frame which is to be subjected to recording when the recording button is pressed at the position (I) in FIG. 20 to start recording.

Recording of the document 34 is made possible by selecting the camera mode through the control keyboard 28. Simultaneously with this mode selecting operation, a bias voltage is applied to the developing electrode 96 in the developing section 66, the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 24 which is positioned within the opening defined by the mask 76 is charged positive.

At the time when the recording button is pressed, the solenoid 234 in the film pressing mechanism has continuously been excited from the previous step. Therefore, the film 24 is pressed by the pressing plate 198 so a to be in pressure contact with the respective end faces of the masks 76, 90 and the frame 164 of the processing head 54. The pressing plate 198 has the through-hole 200 formed in a portion thereof which opposes the mask 76, but this through-hole 200 is smaller than the opening defined by the mask 76. Therefore, a portion of the film 24 which is positioned at the end face of the mask 76 is pressed by the surface of a portion of the pressing plate 198 around the through-hole 200. Accordingly, the film 24 is reliably brought into close contact with the end face of the mask 76, and the charging range is thereby accurately limited within the opening in the mask 76.

Since the mask electrode 82 provided in the charging exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamps 36 are turned ON when a predetermined period of time has elapsed after the recording button has been pressed at the position (I) in FIG. 20, so as to illuminate the document 34 placed on the glass plate 22 of the document table 18. Further, when a predetermined period of time has elasped after the recording button has been pressed, the supply of current to the corona wire 84 is suspended, thus completing the corona discharge operation.

At the same time as the suspension of the energization of the corona wire 84, a shutter (not shown but indicated by the reference symbol A in FIG. 20) is opened, and the light reflected from the document 34 placed on the document table 18 is applied to the film 24 by the optical system shown in FIG. 2. In addition, the automatic exposure controller (not shown but indicated by the reference symbol B in FIG. 20) simultaneously starts integration of the quantity of light.

On the other hand, when a predetermined period of time has elapsed after the recording button has been pressed, the three-way cock 120 shown in FIG. 11(A) is switched so as to allow the pipes 124 and 126 to communicate with each other, and the cam 138 is rotated to circulate the developer 136. This circulation causes the developer 136 in the developer bottle 134 to be stirred.

When the integrated value of the quantity of light reaches a set value, the integration effected by the automatic exposure controller (B) is suspended and, at the same time, the shutter (A) is closed, and the document illuminating lamps 36 are turned OFF. At this point of time, the exposure step is completed, and one frame of the film 24 in a portion thereof which is positioned at the opening defined by the mask 76 has an electrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamps 36, are corrected by the automatic exposure controller (B), an optimal exposure operation is effected at all times. When a predetermined period of time has elapsed after the recording button has been pressed and all the step of processing other frames have already been completed, the solenoid 234 of the film pressing mechanism is immediately de-energized. When the solenoid 234 is de-energized at the position (IA) in FIG. 20, the pressing plate 198 is separated from the film 24.

At the same time as the solenoid 234 of the film pressing mechanism is de-energized, the solenoid 162 of the suction trap 150 shown in FIG. 11(B) is energized to raise the valve 158 through the shaft 160, thus allowing the return pipe 156 to be communicated with the suction trap 150. In consequence, the developer 136 which has been trapped by the suction trap 150 during the previous developing and squeezing step (described later) is returned to the developer bottle 134.

When a predetermined period of time has elapsed after the solenoid 234 of the film pressing mechanism has been deenergized, the film moving motor (not shown but indicated by the reference symbol C in FIG. 20) is activated to move the film 24 rightwardly as viewed in FIG. 6 by a distance corresponding to one frame. Thus, the frame which has been positioned at the charging exposure section 64 is moved to the developing section 66. The movement of the film 24 by one frame is controlled by the blip sensor 196 in a manner similar to the above. More specifically, the movement of the film 24 is suspended when the sensor 196 detects a subsequent blip mark 24A When a predetermined period of time has elapsed after the film moving motor (C) has been suspended, the solenoid 234 of the film pressing mchanism is energized at the position (IB) in FIG. 20, so that the film 24 is pressed against the processing head 54 by the pressing plate 198. At the same time, the solenoid 162 of the suction trap 150 is de-energized so as to close the return pipe 156, and the suction squeezing air pump 154 is activated. In addition, the position of the three-way cock 120 is switched so as to provide communication between the pipes 122 and 126.

When, in this state, the cam 138 is rotated, an amount of developer 136 which is required to develop one frame is allowed to reach the processing head 54 through the pipe 122, and the developer 136 then flows into the developing chamber 98 from the developer and squeezing air inlet 100 in the developing section 66. Since the toner particles dispersed in the developer 136 are charged negative, the toner particles, when flowing down through the developing chamber 98, adhere to portions of the film 24 which are charged positive, thereby developing the electrostatic latent image. The developer 136 having flowed down through the developing chamber 98 is returned to the developer bottle 134 from the developer and squeezing air outlet 102 through the return pipe 146.

Since the film 24 is pressed against the end face of the mask 90 by virtue of the pressing plate 198, substantially no developer 136 enters the gap between the end face of the mask 90 and the film 24 when the developer 136 flows down through the developing chamber 98. Any developer 136 which enters said gap is sucked and trapped into the suction trap 150 from the squeez suction port 114 through the pipe 148 by means of a vacuum produced in each of the recesses 92 which are respectively located on the outer sides of the left and right frame members 90B and 90C of the mask 90, the vacuum being produced by the action of the suction squeezing air pump 154.

Thus, the supply of an amount of developer 136 which is required to develop one frame is continued, and it is therefore possible to minimize possible exposure blur which may be caused by vibrations during the exposure of a subsequent frame.

When the straight portion of the cam 138 comes in contact with the cushioning plate 134A, the supply of the developer 136 to the developing chamber 98 is suspended. At the same time, the pressure squeezing air pump 144 shown in FIG. 11(A) is activated to supply pressurized air to the developing chamber 98 from the developer and squeezing air inlet 100, whereby surplus developer 136 attached to the film 24 is blown off so as to be swished off. The developer 136 thus blown off is returned to the developer bottle 134 from the developer and squeezing air outlet 102 through the return pipe 146.

The supply of the pressurized air to the developing chamber 98 is controlled in such a manner that a relatively weak blast is applied while a relatively large amount of developer 136 remains in the developing chamber 98 in order to prevent deterioration of the quality of the image which would otherwise be caused by an operation of blowing off the developer 136 at high speed. When a predetermined perod of time has elasped after the application of the blast has been started, a relatively strong blast is applied to increase the squeezing efficiency.

The application of the blast is controlled by the charging exposure step for a subsequent frame which has been started in response to the pressing of the recording button at the position (II) in FIG. 20. The application of the blast is suspended at the same time as the drive of the film moving motor (C) is started at the time when a predetermined period of time has elapsed after the solenoid 234 of the film pressing mechanism has been de-energized a the position (IIA) in FIG. 20, thus completing the developing and squeezing step.

It should be noted that the presence of the developing electrode 96 during the developing operation enables obtaining of an image having no edge effect. In addition, the application of a bias voltage to the developing electrode 96 prevents fogging of the image.

When the drive of the film moving motor (C) is suspended, the film 24 has been moved rightwardly as viewed in FIG. 6 by an amount corresponding to one frame, so that a frame which has been positioned at the developing section 66 is now positioned at the drying section 68. When a predetermined period of time has elapsed after the drive of the film moving motor (C) has been suspended, the solenoid 234 of the film pressing mechanism is energized at the position (IIB) in FIG. 20 and, at the same time, the air pump 181 shown in FIG. 16 is activated. In consequence, the air heated by the heater 179 is blown into the drying chamber 174 from the warm air outlet 176 in the drying section 68, and the developer 136 is thereby dried. The operation of the air pump 181 is controlled by the charging exposure step which is started when the recording button is pressed at the position (III) in FIG. 20, and suspended at the same time as the solenoid 234 of the film pressing mechanism is de-energized at the position (IIIA) in FIG. 20, thus completing the drying step.

The temperature of the warm air which is supplied to the drying chamber 174 is detected by the temperature sensor 182, and when the temperature is out of a predetermined range, this fact is displayed on the control keyboard 28. When the temperature of the warm air is excessively high, the supply of current to the heater 179 is immediately suspended.

Although in the above-described embodiment the drying air pump 181 is activated in response to the energization of the solenoid 234 of the film pressing mechanism and only when the film 24 is being pressed against the processing head 54, the air pump 181 may be operated at all times from the start of the operation of the system.

After the solenoid 234 of the film pressing mechanism has been de-energized at the position (IIIA) in FIG. 20, the film moving motor (C) is activated, and the frame which has been positioned at the drying section 68 is thereby moved to the fixing section 70. After the drive of the film moving motor (C) has been suspended, the solenoid 234 of the film pressing mechanism is energized at the position (IIIB) in FIG. 20 and, at the same time, the air pump 195 shown in FIG. 17 is activated to supply cold air to the space 190 in the fixing section 70. The cold air supplied to the space 190 passes through the area defined at the upper edge of the glass plate 186 to reach the fixing chamber 188.

When a predetermined period of time has elapsed after the solenoid 234 of the film pressing mechanism has been energized, the xenon lamp 192 is turned ON, so that the toner particles are fused and fixed to the surface of the film 24, thus completing the fixing step.

Any matter which is vaporized or scattered during the fixing operation is blown off by means of the cold air supplied from the air pump 195, and there is no fear of such matter adhering to the surface of the glass plate 186.

When the above-described steps are finished, the recording of an image on the electrophotographic film 24 is completed.

In the system according to this embodiment, when the recording button is pressed, recording is started, and after the recorded frame positioned at the charging exposure section 64 has been moved to the developing section 66 and when a predetermined period of time has elapsed after the soenoid 234 of the film pressing mechanism has been energized, it becomes possible to record a subsequent frame. To effect continuous recording of following consecutive frames, the recording button is pressed during the period which begins when it becomes possible to record a subsequent frame and which ends when a predetermined period of time has elapsed after the completion of the application of a relatively weak blast to the developing section 66 by the pressure squeezing air pump 144. In consequence, the recording step is repeated, and the processing proceeds as shown in FIG. 20.

When the recording button is not pressed during said period, or when the command to end a series of recording operations is input from the control keyboard 28, the application of a relatively strong blask by the air pump 144 is suspended in accordance with the operation of a timer, and the drying and fixing operations carried out thereafter are also executed in accordance with the timer.

When the reader mode is selected, it is possible to projec the film 24 having images of documents recorded thereon as described above. The electrophotographic system in accordance with this embodiment is arranged such that, when a cassette is loaded in the same way as the above, the reader mode is automatically selected (the third mirror 38 has already been moved from the position shown in FIG. 2 to another position). When a given frame is moved to and stopped at the charging exposure section 64 by an operation similar to the above, the light source of the projecting light source section 46 shown in FIG. 3 is turned ON. The light from the light source is passed through the through-hole 200 provided in the pressing plate 198 and transmitted by the film 24, and the image recorded on the film 24 is enlarged and projected on the screen 16 by the optical system shown in FIG. 3.

At the same time as the light source is turned ON, the air pump 89 shown in FIG. 7 is activated to supply cold air to the charging exposure chamber 72 so as to cool the film 24, thereby preventing the film 24 from being heated to high temperature by the heat from the projecting light source section 46, and thus avoiding any out-of-focus problem due to thermal deformation of the film 24.

In the reader mode, it is possible to continuously view projected images of the film 24 within a short period of time by successively advancing the film 24 for each frame through the control keyboard 28. In such case, every time the film 24 is moved, the shutter (A) is closed in order to prevent flickering due to persistence phenomenon.

When the copy button on the control keyboard 28 is pressed while an image is being projected on the screen 16, the copy mode is selected. In consequence, the copy mirror 52 is moved, and the image being projected on the screen 16 is recorded on a sheet of copying paper 30 by the optical system shown in FIG. 4.

Figure 21:
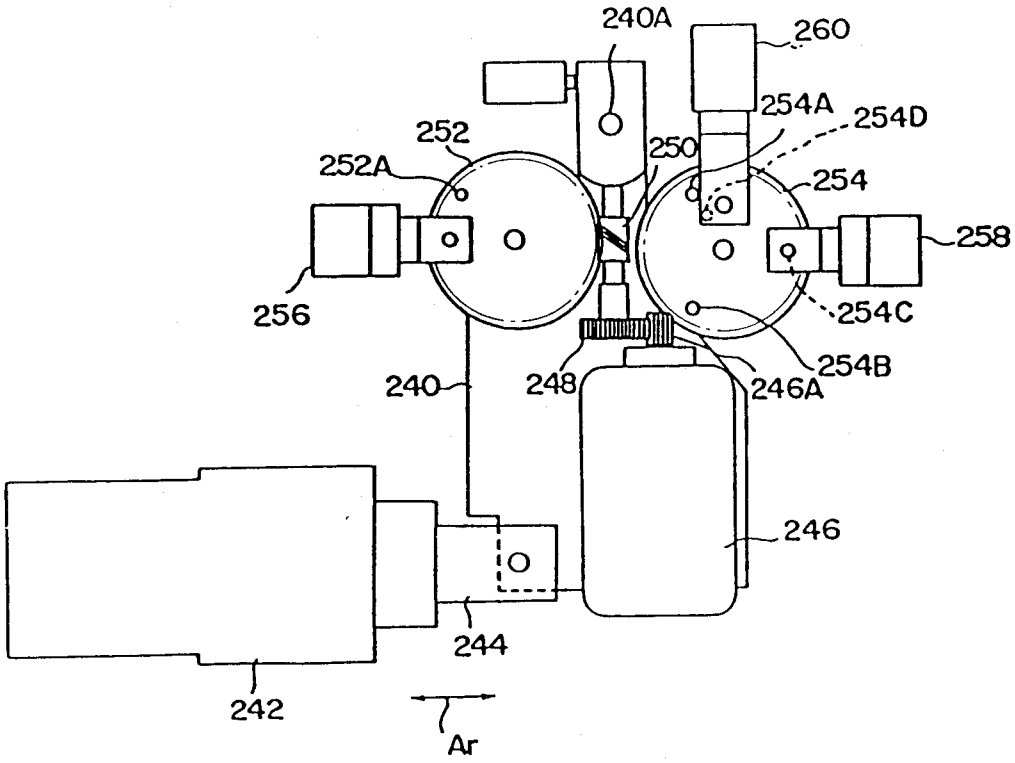
FIG. 21 schematically shows another embodiment of the developer supply apparatus according to the present invention.

Another embodiment of the developer supply apparatus according to the present invention will be described below in detail with reference to FIG. 21. In this embodiment the cam and the valve body of the three-way cock are rotated by a single motor.

A pivoting plate 240 is able to pivot about a pivot point 240A. One end of the plate 24 is connected to one end of a plunger 244 which is reciprocated by the operation of a solenoid 242. Accordingly, when the solenoid 242 is ON/OFF controlled, the plunger 244 is reciprotated in the directions indicated by the arrow Ar in FIG. 21, thus causing the plate 240 to pivot about the pivot point 240A. A motor 246 is fixedly mounted on the plate 240, and a gear 246A is rigidly secured to the output shaft of the motor 246. The gear 246A is meshed with a spur gear 248 rigidly secured to one end of a shaft which has a worm 250 and which is rotatably supported by the plate 240. Worm wheels 252 and 254 are respectively provided on both sides of the worm 250 at a predetermined spacing, the worm wheel 252 being adapted to rotate the cam, and the worm wheel 254 being adapted to rotate the valve body of the three-way cock. The worm wheel 252 is provided with a through-hole 252A which is similar to that described above, and the worm wheel 254 is provided with through-holes 254A to 254C which are similar to those described above, together with a reference throughhole 254D. It should be noted that the reference throughhole 254D may, of course, be employed also in the above-described embodiment. A photointerrupter 256 for detecting the through-hole 252A is disposed in such a manner as to sandwich the worm wheel 252 with clearances therebetween. Further, a photointerrupter 258 for detecting the throughholes 254A to 254C and a photointerrupter 260 for detecting the reference through-hole 254D are disposed in such a manner that each of the photointerrupters 258 and 260 sandwiches the worm wheel 254 with clearances therebeteen. Accordingly, when, in the state shown in FIG. 21, the motor 246 is rotated, the cam is rotated, whereas, when the plate 240 is moved rightward as shown by the arrow Ar in FIG. 21, the position of the three-way cock is switched over from one to another.

Since this embodiment employs only one motor, the production cost can be further lowered, advantageously.

As has been described above, it is possible, according to the present invention, to intermittently supply an amount of developer which is required to develop one frame by converting the rotational motion of the cam into the linear motion of the bellows. Therefore, it is advantageously possible to supply an optimum amount of developer with a simplified arrangement.

Although the present invention has been described through specific terms, it should be noted here that the described embodiments are not exclusive and various changes and modifications may be imparted thereto without departing from the scope of the invention which is limited solely by the appended claims.

What is claimed is:

1. A developer supply apparatus for a processing head which subjects an electrophotographic film to various kinds of processing such as development, said apparatus comprising:

(a) a bellows whose internal volume is variable;

(b) driving means for expanding and contracting said bellows;

(c) a developer supply source;

(d) suction means having a first check valve for allowing the developer to be sucked into said suction means from said developer supply source when said bellows is contracted, for preventing the developer from flowing back to said developer supply source when said bellows is expanded, to suck in a developer from said developer supply source when said bellows is contracted, and to pump out the sucked developer when said bellows is expanded; and (e) a swtiching valve which is selectively set in one of, a first position for delivering the developer pumped out from said suction means to said processing head, and a second position for returning the developer to said developer supply source, whereby, when said valve is in said first position, the developer is forcedly delivered to said processing head, whereas when said valve is in said second position, the developer is stirred to maintain it in a state wherein components of the developer are mixed uniformly.

2. A developer supply apparatus according to claim 1, wherein said driving means is defined by means for pressing said bellows.

3. A developer supply apparatus according to claim 1, wherein said driving means has a cam which is in contact with said bellows through a cushioning plate.

4. A developer supply apparatus according to claim 1, wherein said suction means is interposed between said switching valve and said developer chamber and allows the developer to be delivered to said switching valve when said bellows is expanded, but prevents the developer delivered to said switching valve from flowing backward when said bellows is contracted.

5. A developer supply apparatus according to claim 1, wherein said switching valve is provide with a valve body which selectively allows communication between any two of said suction means, said processing head and said developer supply source.

6. A developer supply apparatus according to claim 5, wherein said switching valve has openings which are respectively communicated with a passage extending from said suction means, a passage to said processing head and a return passage to said developer supply source said openings being positioned around said valve body, the spacing between the passage from said suction means and the return passage to said developer supply source being made equal to the spacing between the passage from said suction means and the passage to said processing head.

7. A developer supply apparatus according to claim 6, wherein said valve body is formed with a passage whose longitudinal axis is bent so that said passage selectively allows communication between two of said three passages.

8. A developer supply apparatus according to claim 1, wherein the driving force from said driving means for expanding and contracting said bellows is switched over so as to be employed to change the position of said switching valve.

9. An apparatus for supplying a developer to a processing head for developing an electrophotographic film, comprising:

(a) a bottle for storing the developer;

(b) a bellows pump for pumping the developer from said bottle by expansion and contraction (c) a switching valve to which the developer stored in said bottle is pumped by said bellows pump, said valve being selectively set in one of, a first position for delivering the developer supplied from said bottle to said processing head, and a second position for returning the developer to said bottle;

(d) said bellows pump having a developer chamber for communicating with said bottle and said switching valve through check valves, respectively; and (e) driving means for driving said bellows so that an amount of developer which is required for one developing operation at said processing head is delivered by one contracting operation of said bellows, whereby an amount of developer which is required for one developing operation is reliably pumped to said processing head by one contracting operation of said bellows.

10. An apparatus according to claim 9, wherein said check valves comprise balls which respectively prevent the developer from flowing back from said developer chamber to said bottle and from said switching valve to said developer chamber.

11. An apparatus according to claim 9, wherein said bellows pump is arranged such that a bellows is expanded and contracted by the operation of a cam.

12. An apparatus according to claim 11, wherein said switching valve is provided with a valve body which is selectively set in two positions, that is, a first position for providing communication between said developer chamber and said processing head, and a second position for providing communication between said developer chamber and said bottle.

13. An apparatus according to claim 12, wherein said switching valve has openings which are respectively communicated with a passage extending from said developer chamber, a passage to said processing head and a return passage to said bottle, said openings being positioned around said valve body, the spacing between the passage from said developer chamber and the passage to said processing head being made equal to the spacing between the passage from said developer chamber and the return passage to said bottle.

14. An apparatus according to claim 13, wherein said valve body is provided with a bore whose longitudinal axis is bent so that said bore selectively allows communication between said three passages.

15. A developer supply apparatus for supplying a developer to a processing head which electrically charges an electrophotographic film, forms an image on said film by light exposure and then develops said image, said apparatus comprising:

(a) a bottle for storing the developer;

(b) a developer chamber communicated with said bottle;

(c) a first check valve interposed between said developer chamber and said bottle to prevent the developer from flowing back from said developer chamber to said bottle;

(d) a bellows pump for sucking up the developer from said bottle into said developer chamber and pumping out the sucked developer;

(e) a switching valve to which the developer is pumped from said developer chamber, said switching valve being selectively set in two positions, that is, a first position for delivering the developer from said developer chamber to said processing head, and a second position for returning the developer to said bottle;

(f) a second check valve interposed between said switching valve and said developer chamber to prevent the developer from flowing back from said switching valve to said developer chamber; and (g) driving means for driving said bellows pump so that an amount of developer which is sufficient for said processing head to effect one developing operation on said film is supplied to said processing head, whereby said switching valve provides communication between said developer chamber and said bottle to stir the developer, and when a developing operation is to be carried out, a sufficient amount of developer is delivered to said processing head with one stroke of said bellows pump, thereby reliably effecting a developing operation.

16. A developer supply apparatus according to claim 15, wherein said bellows pump has a bellows which is able to expand and contract and which is capable of supplying an amount of developer which is adequate to effect one developing operation with one stroke, and a com which acts so as to expand and contract said bellows.

17. A developer supply apparatus according to claim 15, wherein said switching valve has a valve body which is selectively set in said two positions by rotating the same.

18. A developer supply apparatus according to claim 17, wherein said switching valve is provided with a sensor for detecting the rotational position of said valve body, and means for controlling the rotational position of said valve body in response to a signal delivered from said sensor.

* * * * *